US010222714B2

(12) United States Patent
Fukaya

(10) Patent No.: US 10,222,714 B2
(45) Date of Patent: Mar. 5, 2019

(54) ELECTROPHOTOGRAPHIC PHOTORECEPTOR AND IMAGE FORMING APPARATUS

(71) Applicant: KYOCERA CORPORATION, Kyoto (JP)

(72) Inventor: Tomomi Fukaya, Hikone (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/920,174

(22) Filed: Mar. 13, 2018

(65) Prior Publication Data

US 2018/0275536 A1 Sep. 27, 2018

(30) Foreign Application Priority Data

Mar. 27, 2017 (JP) ..... 2017-061987
Mar. 5, 2018 (JP) ..... 2018-039034

(51) Int. Cl.

| | |
|---|---|
| ***G03G 5/10*** | (2006.01) |
| ***G03G 5/02*** | (2006.01) |
| ***G03G 7/00*** | (2006.01) |
| ***G03G 15/00*** | (2006.01) |

(52) U.S. Cl.
CPC ..... *G03G 5/0217* (2013.01); *G03G 7/0013* (2013.01); *G03G 15/751* (2013.01)

(58) Field of Classification Search
CPC ..... G03G 5/0202; G03G 5/0205; G03G 5/10; G03G 5/102; G03G 5/147; G03G 5/14704; G03G 5/14708; G03G 5/14713
USPC ..... 492/27, 38, 48, 16, 18, 25, 28, 40; D18/40, 18, 56
See application file for complete search history.

(56) References Cited

U.S. PATENT DOCUMENTS 6,421,511 B2 * 7/2002 Sugiyama ..... G03G 15/168 399/101
7,464,467 B2 * 12/2008 Fukuyama ..... B65H 27/00 29/895
2008/0003016 A1 1/2008 Nakano

FOREIGN PATENT DOCUMENTS

JP 2008-14964 A 1/2008

* cited by examiner

*Primary Examiner* — Hoa V Le
(74) *Attorney, Agent, or Firm* — Duane Morris LLP

(57) ABSTRACT

An electrophotographic photoreceptor includes: a cylindrical base body having a two-step stepped chamfer between a base body outer peripheral face and a base body end face; and a surface layer located on the base body outer peripheral face. The cylindrical base body has an outer chamfered face and an inner chamfered face lying closer to an end face than the outer chamfered face. A length L2 of the inner chamfered face is larger than a length L1 of the outer chamfered face, namely L1<L2, as viewed in lateral section taken along a rotation axis of the cylindrical base body.

12 Claims, 4 Drawing Sheets

ELECTROPHOTOGRAPHIC PHOTORECEPTOR AND IMAGE FORMING APPARATUS

BACKGROUND OF THE INVENTION

1. Field of the Invention

The present invention relates to an electrophotographic photoreceptor and an image forming apparatus including the electrophotographic photoreceptor.

2. Description of the Related Art

An electrophotographic photoreceptor for use in an image forming apparatus is constructed by, for example, forming a surface layer on a surface of an outer peripheral face (outer surface) of a cylindrical base body, the surface layer being composed of a charge injection preventive layer, a photoconductive layer, a surface protecting layer, etc. In connection with such an electrophotographic photoreceptor, the applicant has made a proposition in Patent Literature 1 about an electrophotographic photoreceptor in which a cylindrical base body constituting the electrophotographic photoreceptor is chamfered at an end thereof to provide an at least two-step stepped chamfer (a plurality of chamfered faces), and in a film-forming process to produce a surface layer, the surface layer is formed so as to be deposited also on the chamfered face, in consequence whereof there can result little filming imperfections, such as the appearance of minute projections generated in the surface layer formed on the outer peripheral face of the cylindrical base body, in the film-forming process.

CITATION LIST

Patent Literature

Patent Literature 1: Japanese Unexamined Patent Publication JP-A 2008-14964

SUMMARY OF THE INVENTION

However, in the course of manufacture of the electrophotographic photoreceptor, during the film-forming process to produce the surface layer (a charge injection preventive layer, a photoconductive layer, and a surface protecting layer), if part of a film which is still in process of being deposited is separated from the end, or in particular the chamfered face, of the base body, the fly-off of the separated piece inside a film-forming chamber may adhere to the outer peripheral face of the base body which will serve as a printing portion in a final product, which leads to impairment of the surface flatness of the printing portion and image defects such as appearance of an unusual stripe on a printed image.

This has created demands for an electrophotographic photoreceptor which is capable of reducing the occurrence of unusual events such as separation or dropping-off of a film from a base body end during the stage of film formation to produce a surface layer, and is also capable of maintaining and reproducing stable printed-image quality during the usage stage after commercialization, and for an image forming apparatus equipped with the electrophotographic photoreceptor.

An electrophotographic photoreceptor in accordance with an embodiment of the invention comprises: a cylindrical base body having an outer peripheral face, an end face, and a chamfered face disposed between the outer peripheral face and the end face; and a surface layer located on the outer peripheral face, the cylindrical base body including an outer chamfered face, and an inner chamfered face lying closer to the end face than the outer chamfered face, a length of the inner chamfered face being larger than a length of the outer chamfered face, as viewed in lateral section taken along a rotation axis of the cylindrical base body.

Moreover, an image forming apparatus in accordance with an embodiment of the invention comprises the above-described electrophotographic photoreceptor.

The electrophotographic photoreceptor and the image forming apparatus in accordance with the embodiment of the invention, during a film-forming process to produce the surface layer, the occurrence of trouble such as separation or dropping-off of a film from the chamfered face at each end of the cylindrical base body is reduced. Therefore, this makes it possible to reduce the occurrence of unusual events ascribable to such a trouble which may be encountered after commercialization. Consequently, it is possible to maintain and reproduce stable printed-image quality during the usage stage after commercialization.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
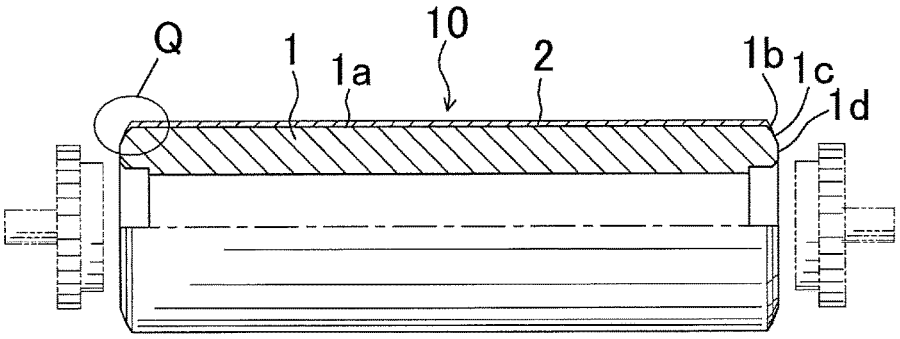
FIG. 1A is a semi-sectional view showing an electrophotographic photoreceptor in accordance with an embodiment of the invention.

Now referring to the drawings, an electrophotographic photoreceptor and an image forming apparatus equipped with the electrophotographic photoreceptor in accordance with preferred embodiments of the invention are described below. It is to be understood that the following is considered as illustrative only of the embodiments of the invention, and the application of the invention is not limited to the following embodiments.

Figure 1B:
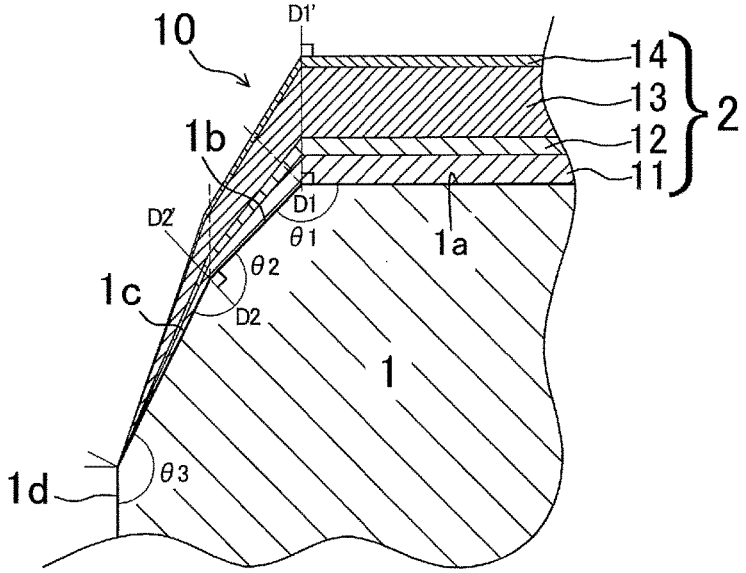
FIG. 1B is a schematic sectional view showing a part Q of the construction shown in FIG. 1A in enlarged dimension.
Figure 2A:
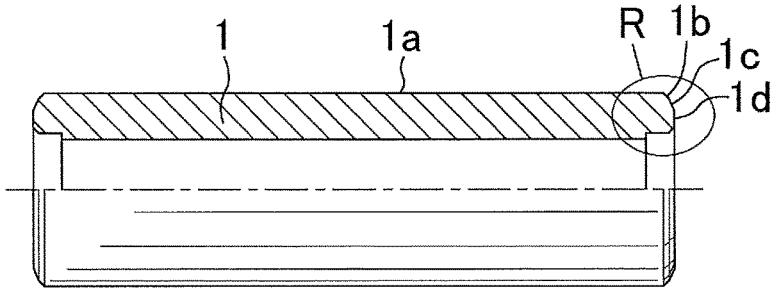
FIG. 2A is a semi-sectional view of a cylindrical base body used for the electrophotographic photoreceptor in accordance with the embodiment of the invention.
Figure 2B:
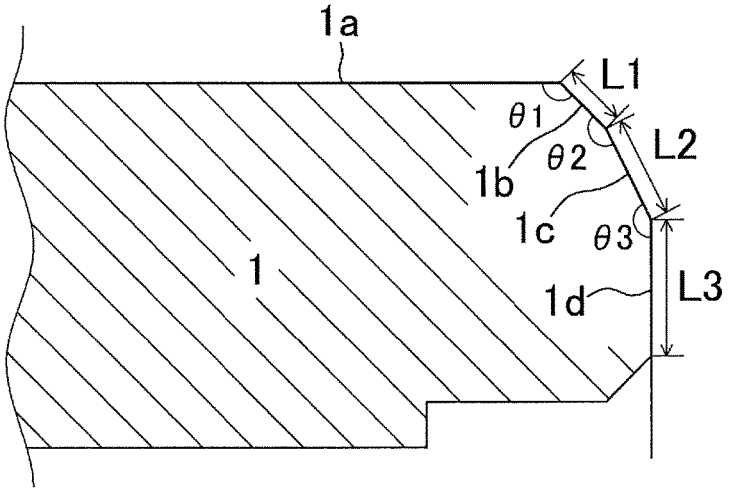
FIG. 2B is a schematic sectional view showing a part R of the construction shown in FIG. 2A in enlarged dimension.
Figure 2C:
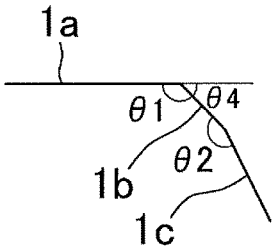
FIG. 2C is a schematic view showing part of the part R in enlarged dimension.
Figure 3:
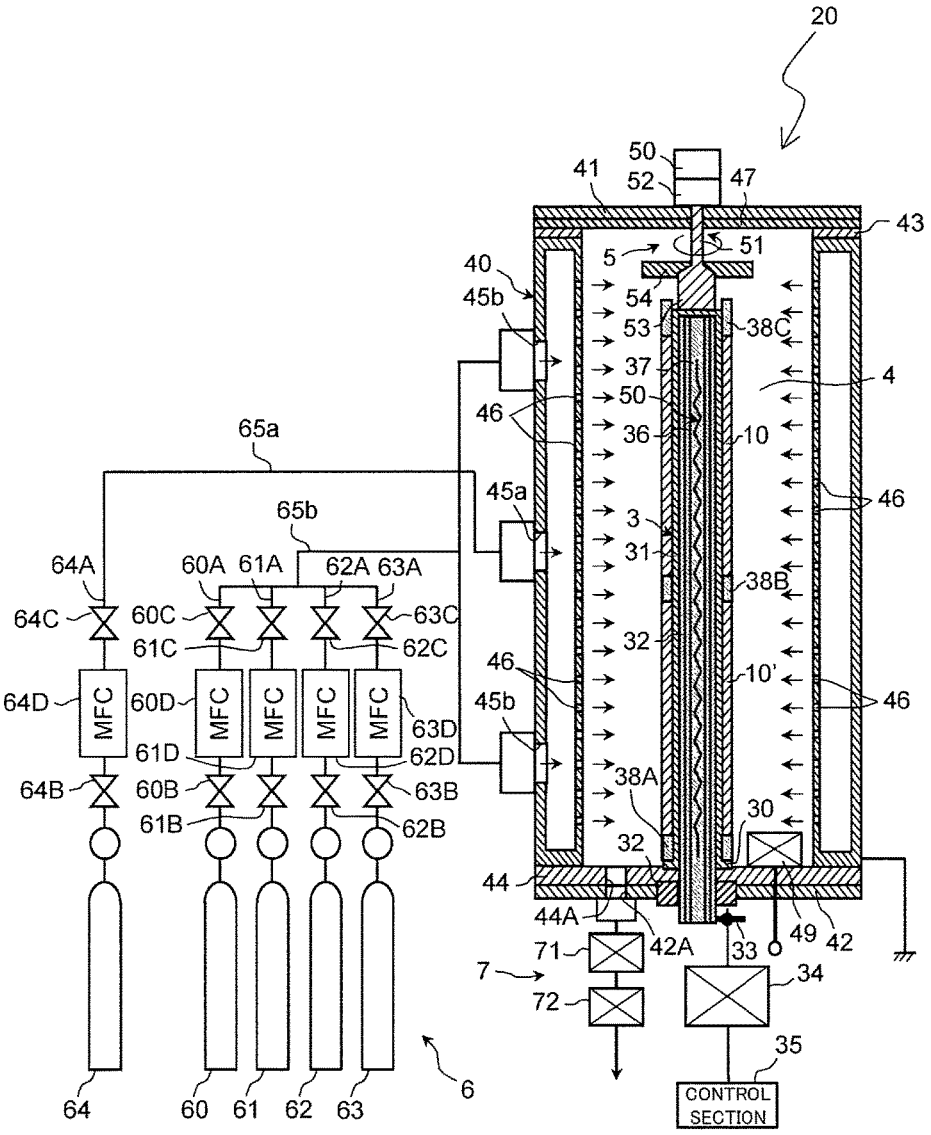
FIG. 3 is a diagrammatic representation of a deposited film forming apparatus for use in the manufacture of the electrophotographic photoreceptor.
Figure 4:
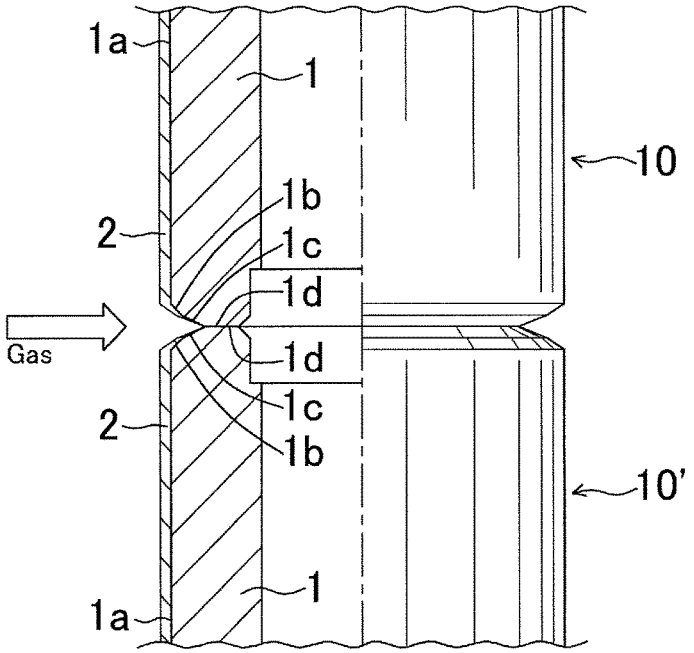
FIG. 4 is a semi-sectional view showing how the electrophotographic photoreceptors are to be stacked on top of each other in the deposited film forming apparatus.

With use of a deposited film forming apparatus 20 shown in FIG. 3, an electrophotographic photoreceptor 10 shown in FIGS. 1A and 1B is constructed by stacking two cylindrical base bodies 1 shown in FIGS. 2A to 2C in a longitudinal (vertical) direction within the deposited film forming apparatus as shown in FIG. 4, and thereafter forming a surface layer 2 on the surface of the two cylindrical base bodies 1 (mainly on the base body outer peripheral face 1*a*) by a film-forming process, and more specifically by sequentially laminating a voltage-resistant layer 11, a charge injection preventive layer 12, a photoconductive layer 13, and a surface protecting layer 14 in the order named on that surface. It is noted that a combination of the charge injection preventive layer 12 and the photoconductive layer 13 may hereafter be also referred to as "photosensitive layer". Moreover, in the surface layer 2 shown in FIGS. 1A, 1B and 4, each constituent layer (film) is slightly exaggerated in thickness for purposes of illustration, wherefore a ratio, such as a film-thickness ratio and an asperity ratio, among the constituent layers differs from an actual measured value. This holds true for FIGS. 3 and 5.

As shown in FIGS. 2A to 2C, prior to the film-forming process, the cylindrical base body 1 serves as a support for the surface layer 2, and exhibits, at least at a surface thereof, electrical conductivity. The cylindrical base body 1 is made electrically conductive in its entirety from a metal material such for example as aluminum (Al), stainless steel (SUS), zinc (Zn), copper (Cu), iron (Fe), titanium (Ti), nickel (Ni), chromium (Cr), tantalum (Ta), tin (Sn), gold (Au), silver (Ag), magnesium (Mg), and manganese (Mn), or an alloy containing each such metal material as exemplified.

In the alternative, the cylindrical base body 1 may be constructed by depositing an electrically conductive film formed of the exemplified metal material and a transparent conductive material such as ITO (Indium Tin Oxide) or $SnO_2$ (tin dioxide) on the surface of resin, glass, ceramics, etc.

Among such materials as exemplified, an aluminum (Al)-based material is suitable for use as the material of construction of the cylindrical base body 1. Forming the cylindrical base body 1 as a whole from the aluminum (Al)-based material makes it possible to produce the lightweight electrophotographic photoreceptor 10 at low cost. Besides, forming each of the charge injection preventive layer 12 and the photoconductive layer 13 from an amorphous silicon (a-Si)-based material makes it possible to increase the degree of adhesion between each layer and the cylindrical base body 1, and thereby achieve improvement in reliability.

The surface of the cylindrical base body 1 (base body outer peripheral face 1*a*) may be subjected to rough finishing. In this case, the surface roughening process is effected in a manner whereby the surface roughness of the roughened base body outer peripheral face 1*a* falls in the range of not less than 50 nm and not more than 140 nm in terms of arithmetic mean height Sa. Examples of surface roughening technique include wet blasting, sputter etching, gas etching, grinding, machining, wet etching, and galvanic corrosion. It is noted that a drawn pipe which fulfills the above-described surface roughness (Sa value) may be used in an as-is state for the cylindrical base body without the necessity of performing surface treatment for surface texture adjustment. In the embodiment, a part of the surface (surface region) which is set for an arithmetic mean height Sa of greater than or equal to 25 nm is referred to as "rough surface".

Moreover, the base body outer peripheral face 1*a* may be subjected to mirror finishing prior to the described surface roughening process. In this case, after the mirror finishing process, oil content removal is done before the surface roughening process. The mirror finishing process is effected in a manner whereby the surface roughness of the mirror-finished cylindrical base body 1 is less than 25 nm in terms of arithmetic mean height Sa. In the embodiment, a part of the surface (surface region) which is set for an arithmetic mean height Sa of less than 25 nm is referred to as "mirror-finished surface".

As employed in the specification, "arithmetic mean height Sa" refers to one of parameters indicative of three-dimensional surface texture defined by ISO 25178, which represents an arithmetic average (unit: nm) of absolute values of a height from the average plane of a surface within the range of a measurement target area. Moreover, the surface texture measurement has been made by LEXT OLS-4100 3D Measuring Laser Microscope manufactured by Olympus Corporation with use of ISO 25178-compliant three-dimensional surface roughness parameters. The measurement of the electrophotographic photoreceptor 10 (surface layer) has been accomplished simply by obtaining measurements of the product surface. On the other hand, for the measurement of the outer surface of the cylindrical base body 1 (base body outer peripheral face 1*a*) located beneath the surface layer 2, the surface layer has been removed from the electrophotographic photoreceptor product by dry etching using a gas such as $ClF_3$ or $CF_4$ in advance of the measurement.

Moreover, in the electrophotographic photoreceptor 10, the entire area of the surface protecting layer 14 does not necessarily have to fulfill the specified range of surface texture. For example, the surface texture at each end of the cylindrical base body 1 in an axial direction may take on a value which falls outside the specified range.

A brief description of each layer constituting the surface layer 2 will be given below. As shown in FIG. 1B, the voltage-resistant layer 11, which is closest to and adherent to the cylindrical base body 1, is an amorphous silicon nitride (a-SiN)-containing layer which serves to improve the withstand voltage characteristics of the surface cover layer. In the voltage-resistant layer 11 (amorphous silicon nitride-containing layer), the ratio of the number of nitrogen atoms to the total number of nitrogen atoms and silicon atoms (N/(Si+N)) is less than or equal to 0.32. By setting the numbers of silicon atoms and nitrogen atoms so as to fulfill such a ratio, it is possible to ensure adequate withstand voltage characteristics in the surface layer, and also to reduce the occurrence of residual potential properly. As the voltage-resistant layer 11, for example, it is possible to use a layer composed of amorphous silicon (a-Si) with, at least, nitrogen (N) added as a dopant. A thickness of the voltage-resistant layer 11 is set to 0.5 μm to 15 μm. The voltage-resistant layer 11 may be also referred to as a withstand voltage layer or a voltage holding layer.

The charge injection preventive layer 12 serves to prevent injection of carriers (electrons) from the cylindrical base body 1. For example, the charge injection preventive layer 12 is formed of an amorphous silicon (a-Si)-based material. As the charge injection preventive layer 12, for example, it is possible to use a layer composed of amorphous silicon (a-Si) with boron (B), and, on an as needed basis, nitrogen (N) or oxygen (O), or both of them, added as a dopant, or amorphous silicon (a-Si) with phosphorus (P), and, on an as needed basis, nitrogen (N) or oxygen (O), or both of them, added as a dopant. A thickness of the charge injection preventive layer 12 is set to 2 μm to 10 μm.

The photoconductive layer 13 serves to produce carriers by irradiation of light such as laser light. For example, the photoconductive layer 13 is formed of an amorphous silicon (a-Si)-based material and an amorphous selenium (a-Se)-based material such as Se—Te or $As_2Se_3$. The photoconductive layer 13 is, as exemplified, formed of amorphous silicon (a-Si) and an amorphous silicon (a-Si)-based material formed of amorphous silicon (a-Si) with carbon (C), nitrogen (N), oxygen (O), etc. added, and also has a content of boron (B) or phosphorus (P) as a dopant. When the photoconductive layer 13 is formed of an amorphous silicon (a-Si)-based material, a thickness thereof may be set to about 5 μm to 100 μm, or more specifically 10 μm to 80 μm.

The surface protecting layer 14 serves to protect the surface of the photosensitive layer 13. For example, the surface protecting layer 14 may be formed of an amorphous silicon (a-Si)-based material such as amorphous silicon carbide (a-SiC) or amorphous silicon nitride (a-SiN), or of amorphous carbon (a-C), or, alternatively, it may be given a multilayer structure composed of layers of such materials. The surface protecting layer 14 becomes the outermost layer following the completion of the film-forming process. Thus, from the standpoint of wear resistance against rubbing movement in the interior of the image forming apparatus, the surface protecting layer 14 is, as exemplified, formed of highly wear-resistant amorphous carbon (a-C). The thickness of the surface protecting layer 14 may be adjusted to an appropriate level in accordance with the endurance limit as to the number of prints required of the electrophotographic photoreceptor 10. That is, there is no need to render the surface protecting layer 14 thicker than it needs to be. For example, a thickness of the surface protecting layer 14 may be set to 0.1 μm to 2 um, or more specifically 0.5 μm to 1.5 μm.

The following describes, with reference to FIGS. 2A to 2C, the cylindrical base body 1 having a two-step stepped chamfer (denoted 1*b* and 1*c* in the drawing) which is formed at a corner of the electrophotographic photoreceptor 10 in an axial direction of the cylinder, or equivalently formed at a location between the base body outer peripheral face 1*a* and a base body end face 1*d* of the cylindrical base body 1 which has yet to undergo the film-forming process, so as to round off the sharp edge to some extent. As described earlier, in FIGS. 2A to 2C, there is shown the cylindrical base body 1 which is still free of the surface layer 2 to be formed on the surface of the base body by, for example, a plasma CVD (Chemical Vapor Deposition) system 20 as will hereafter be described. Although the electrophotographic photoreceptor 10 is illustrated as having a two-step stepped chamfer in the embodiment, an at least three-step stepped chamfer may be adopted instead.

At each axial end of the cylindrical base body 1 shown in FIG. 2B in enlarged dimension, there are provided an outer chamfered face 1*b* in the form of a bevel (C-face) and an inner chamfered face 1*c* in a similar bevel form which have different angles of inclination. The outer chamfered face 1*b* and the inner chamfered face 1*c* are formed between the base body outer peripheral face 1*a* and the base body end face 1*d* in a beveling process by machining operation.

The outer chamfered face 1*b* is made continuous with the base body outer peripheral face 1*a*. When the outer chamfered face 1*b* is viewed in lateral section taken along the rotation axis of the cylindrical base body 1 as shown in FIG. 2B, then a length L1 (mm) thereof falls in the range of about 0.03 to 0.20 mm, for example. Although the outer chamfered face 1*b* is made continuous with the base body outer peripheral face 1*a* in the embodiment, such a structure that the outer chamfered face 1*b* and the base body outer peripheral face 1*a* are not completely continuous with each other can be adopted.

On the other hand, the inner chamfered face 1*c* is made continuous at one end (upper end, viewing the drawing) thereof with the outer chamfered face 1*b*, and continuous at other end (lower end, viewing the drawing) thereof with the base body end face 1*d*. Moreover, when the inner chamfered face 1*c* is viewed in lateral section taken along the rotation axis of the cylindrical base body 1 as shown in FIG. 2B, then a length L2 (mm) thereof falls in the range of about 0.2 to 0.5 mm, for example. Although the inner chamfered face 1*c* is made continuous with both of the outer chamfered face 1*b* and the base body end face 1*d* in the embodiment, such a structure that the inner chamfered face 1*c* and each of the outer chamfered face 1*b* and the base body end face 1*d* are not completely continuous with each other can be adopted.

A comparison between the length L2 of the inner chamfered face 1*c* in the inclination direction and the length L1 of the outer chamfered face 1*b* in the inclination direction indicates that, in the cylindrical base body 1 in the embodiment, the length L2 of the inner chamfered face 1*c* is larger than the length L1 of the outer chamfered face 1*b* (L1<L2).

Moreover, when the base body end face 1*d* is viewed in lateral section taken along the rotation axis of the same cylindrical base body 1, then a length L3 of the base body end face 1*d* in the radial direction is larger than the length L2 of the inner chamfered face 1*c* in the inclination direction (L2<L3).

That is, in the cylindrical base body 1 in the embodiment as viewed in lateral section, the relationship expressed as Expression (1) is employed among the length L3 of the base body end face 1*d*, the length L2 of the inner chamfered face 1*c*, and the length L1 of the outer chamfered face 1*b*:

$$L1<L2<L3 \quad (1).$$

With such a structure, the electrophotographic photoreceptor 10 in the embodiment suffers little from trouble such as separation or dropping-off of a film from the two-step stepped chamfer (chamfered faces 1*b* and 1*c*) at the end of the base body, even during the formation of the surface layer 2 (film-forming process) under the condition that a plurality of the electrophotographic photoreceptors are vertically stacked on top of each other as shown in FIG. 4 in the plasma CVD system 20 shown in FIG. 3. This makes it possible to reduce the occurrence of image defects ascribable to such a trouble which may be encountered after commercialization. Moreover, even if trouble such as film separation or dropping-off takes place, the separated or dropped piece is so small that the occurrence of image defects which may be encountered after commercialization can be reduced.

Meanwhile, when each end of the cylindrical base body 1 is observed in light of the angle of intersection between the mutually corresponding faces, given that, in the lateral section taken along the rotation axis of the same cylindrical base body (FIG. 2B), the internal angle defined by the base body outer peripheral face 1*a* and the radially outermost outer chamfered face 1*b* is θ1, the internal angle defined by the outer chamfered face 1*b* and the inner chamfered face 1*c* which is continuous therewith is θ2, and the internal angle defined by the inner chamfered face 1*c* and the radially innermost base body end face 1*d* is θ3, then the cylindrical base body 1 is configured so that the internal angle θ1 is smaller than the internal angle θ2 (θ1<θ2).

Moreover, in the cylindrical base body 1, the internal angle θ1 defined by the base body outer peripheral face 1*a* and the outer chamfered face 1*b* is greater than 90° but less than or equal to 135°. As shown in FIG. 2C, with the internal angle θl observed with respect to the base body outer peripheral face 1*a*, the angle θ4 at which the outer chamfered face 1*b* is intersected by the base body outer peripheral face 1*a* (intersection angle θ4) is greater than or equal to 45° but less than 90°.

Like the fulfillment of the earlier described relationship expressed as Expression (1), even with such structure, it is possible to reduce the occurrence of trouble such as separation or dropping-off of a film from the two-step stepped chamfer (chamfered faces 1*b* and 1*c*) at the end of the base body. Moreover, in the event of the separation or dropping-off, it is possible to reduce the separated or dropped piece is so small that the occurrence of image defects which may be encountered after commercialization.

Subsequent to the chamfering process to obtain the two-step stepped chamfer (or mirror-finishing process), the earlier described surface roughening process is performed on each end of the cylindrical base body 1 by surface roughening technique such as wet blasting. Consequently, the surface roughness (arithmetic mean height Sa) of the outer chamfered face 1*b* is greater than the arithmetic mean height Sa of the base body outer peripheral face 1*a*, and, the arithmetic mean height Sa of the inner chamfered face 1*c* is greater than the arithmetic mean height Sa of the base body outer peripheral face 1*a*.

The anchor effect produced by the surface roughening process helps enhance the adherability of each chamfered face (the outer chamfered face 1*b*, in particular) of the cylindrical base body 1 to the surface layer 2. This helps minimize the occurrence of separation or dropping-off of a film from the end of the base body during the stage of film formation to produce the surface layer 2.

The following describes a film-forming method for producing the surface layer 2 using the cylindrical base body 1 having the above-described end configuration.

As described earlier, the surface layer 2 is formed by stacking the voltage-resistant layer 11, the charge injection preventive layer 12, the photoconductive layer 13, and the surface protecting layer 14 one after another in the order named. The layering operation is effected by a plasma CVD system 20 as shown in FIG. 3, for example.

The plasma CVD system 20 shown in FIG. 3 is constructed of a vacuum reaction chamber 4 which receives therein a support substrate 3, and also includes a rotating section 5, a raw material gas supply section 6, an exhaust section 7, etc.

The support substrate 3 serves to support a stack of the cylindrical base bodies 1 (shown as electrophotographic photoreceptors 10 and 10' in the drawing). The support substrate 3 in the form of a hollow body having a flange portion 30 is formed as a conductor in its entirety from an electrically conductive material similar to that used for the cylindrical base body 1.

The conductive support 31, which is formed as a conductor in its entirety from an electrically conductive material similar to that used for the cylindrical base body 1, is secured via an insulating material 32 to a plate 42 which will hereafter be described in the center of the vacuum reaction chamber 4 (a cylindrical electrode 40 as will hereafter be described). A DC power supply 34 is connected via a conducting plate 33 to the conductive support 31. Moreover, a control section 35 is configured to control the DC power supply 34 so as to feed a DC voltage in pulse form to the support substrate 3 through the conductive support 31.

A heater 37 is housed in the conductive support 31 via a ceramic pipe 36.

By turning the heater 37 on and off, the temperature of the support 3 is maintained within a certain range of temperatures selected from a range of not lower than 200° C. but not higher than 400° C., for example.

The vacuum reaction chamber 4, which is a space for forming a deposited film on the cylindrical base body 1, is defined by the cylindrical electrode 40 and a pair of plates 41 and 42 joined thereto via insulating members 43 and 44, respectively.

The cylindrical electrode 40 has such size that a distance between the cylindrical base body 1 supported on the support substrate 3 (shown as the electrophotographic photoreceptor 10, 10' in the drawing) and the cylindrical electrode 40 is not less than 10 mm but not more than 100 mm.

The cylindrical electrode 40 are provided with gas introduction ports 45*a* and 45*b* and a plurality of gas outlet holes 46. The cylindrical electrode 40 may be grounded at one end thereof, and yet, when not grounded, the cylindrical electrode 40 may be connected to a reference power supply provided independently of the DC power supply 34.

The gas introduction port 45*a* serves to introduce a raw material gas for exclusive use for the dopant of the photoconductive layer 13, which is to be fed into the vacuum reaction chamber 4. The gas introduction port 45*b* serves to introduce a raw material gas which is to be fed into the vacuum reaction chamber 4. The gas introduction ports 45*a* and 45*b* are each connected to the raw material gas supply section 6.

A plurality of the gas outlet holes 46 serve to allow the introduced raw material gas within the cylindrical electrode 40 to blow out toward the cylindrical base body 1. The gas outlet holes 46 are arranged equidistantly in a direction from top to bottom of the drawing, and are also arranged equidistantly in a circumferential direction of the cylindrical electrode 40.

The opening and closing of the plate 41 permit insertion and withdrawal of the support substrate 3 in and from the vacuum reaction chamber 4. A deposition preventive plate 47 is attached to a lower side of the plate 41, and the deposition preventive plate 47 prevents a deposited film from being formed on the plate 41.

The plate 42 constitutes a base of the vacuum reaction chamber 4. The insulating member 44 interposed between the plate 42 and the cylindrical electrode 40 serves to restrain arc discharge from arising between the cylindrical electrode 40 and the plate 42.

The plate 42 and the insulating member 44 are provided with gas discharge ports 42A and 44A and a pressure gauge 49. The gas discharge ports 42A and 44A serve to discharge a gas existing inside the vacuum reaction chamber 4, and are connected to the exhaust section 7. The pressure gauge 49 serves to monitor pressure in the vacuum reaction chamber 4. As the pressure gauge 49, any of heretofore known various pressure gauges can be used.

The rotating section 5 serves to rotate the support substrate 3, and comprises a rotary motor 50 and a rotational force-transmitting mechanism 51.

The rotary motor 50 imparts a rotational force to the cylindrical base body 1. As the rotary motor 50, any of heretofore known various rotary motors can be used.

The rotational force-transmitting mechanism 51 serves to transmit and input the rotational force exerted by the rotary motor 50 to the cylindrical base body 1. The rotational force-transmitting mechanism 51 comprises a rotation-introducing terminal 52, an insulating shaft member 53, and an insulating flat plate 54.

The rotation-introducing terminal 52 serves to transmit a rotational force while maintaining a vacuum in the vacuum reaction chamber 4.

The insulating shaft member 53 and the insulating flat plate 54 serve to input the rotational force exerted by the rotary motor 50 to the support substrate 3 while maintaining an insulating state between the support substrate 3 and the plate 41. For example, the insulating shaft member 53 and the insulating flat plate 54 are formed of an insulating material similar to that used for the insulating member 44.

The insulating flat plate 54 serves to protect the cylindrical base body 1 from adhesion of foreign matter such as dirt or dust fallen from above at the time of detachment of the plate 41.

The raw material gas supply section 6 comprises: a plurality of raw material gas tanks 60, 61, 62, and 63; a raw material gas tank 64 for exclusive use for the dopant of the photoconductive layer 13; a plurality of pipings 60A, 61A, 62A, 63A, and 64A; valves 60B, 61B, 62B, 63B, 64B, 60C, 61C, 62C, 63C, and 64C; and a plurality of mass flow controllers 60D, 61D, 62D, 63D, and 64D. Via pipings 65*a* and 65*b* and the gas introduction ports 45*a* and 45*b*, the raw material gas supply section 6 is connected to the cylindrical electrode 40.

The raw material gas tanks 60 to 64 are each filled with $B_2H_6$ (or $PH_3$), $H_2$ (or He), $CH_4$, or $SiH_4$, for example. The valves 60B to 64B and 60C to 64C, and the mass flow controllers 60D to 64D serve to adjust the flow rate, the composition, and the gas pressure of each raw material gas component or a gas component for exclusive use for the dopant of the photoconductive layer 13 which is introduced into the vacuum reaction chamber 4.

The exhaust section 7 serves to discharge gas existing in the vacuum reaction chamber 4 through the gas discharge ports 42A and 44A to the outside. The exhaust section 7 comprises a mechanical booster pump 71 and a rotary pump 72. these pumps 71 and 72 are controlled in operation on the basis of the result of monitoring by the pressure gauge 49.

The use of such a plasma CVD system 20 makes it possible to perform the surface roughening process and the process of forming each layer sequentially, while maintaining the interior of the vacuum reaction chamber 4 under a vacuum, by a single system.

The following describes a deposited film-forming method using the plasma CVD system 20.

First, in order to form a deposited film (a-Si film) on the cylindrical base body 1, the plate 41 of the plasma CVD system 20 is removed, the support substrate 3 bearing a plurality of the cylindrical base bodies 1 (two cylindrical base bodies in the drawing) is set inside the vacuum reaction chamber 4, and then, the plate 41 is attached once again. FIG. 4 shows the part of connection between the cylindrical base bodies 1.

In order to support the two cylindrical base bodies 1 on the support substrate 3, on the flange portion 30, a lower dummy base 38A, the cylindrical base body 1, an intermediate dummy base 38B, the cylindrical base body 1, and an upper dummy base 38C are successively stacked so as to cover the principal part of the support substrate 3. Herein, a structure in which the intermediate dummy base 38B is disposed between the cylindrical base bodies 1 is exemplified. However, the intermediate dummy base 38 is not always necessary. As shown in FIG. 4, the cylindrical base bodies 1 may be directly stacked one on top of another.

As each of the dummy bases 38A to 38C, a component obtained by performing conducting treatment on the surface of a conductive or insulating body is selected in accordance with product application. Under normal circumstances, it is possible to use a component formed in cylindrical shape from a material similar to that used for the cylindrical base body 1.

The lower dummy base 38A serves to adjust the level of the cylindrical base body 1. The intermediate dummy base 38B serves to reduce film imperfections in the cylindrical base body 1 due to arc discharge arising between the ends of the adjacent cylindrical base bodies 1. The upper dummy base 38C serves to prevent formation of a deposited film on the support substrate 3 to reduce film imperfections caused by separation of a film-forming body once deposited during the film-forming process.

Then, the vacuum reaction chamber 4 is brought into an enclosed space, the rotating section 5 is operated so as to rotate the cylindrical base body 1 via the support substrate 3, the cylindrical base body 1 is heated, and the vacuum reaction chamber 4 is subjected to pressure reduction by the exhaust section 7.

For example, the heating of the cylindrical base body 1 is performed by actuating the heater 37 to produce heat under the supply of external electric power. In the case of forming an amorphous silicon (a-Si) film, for example, the temperature of the cylindrical base body 1 is set to be not lower than 250° C. but not higher than 300° C.

Meanwhile, pressure reduction is effected in the vacuum reaction chamber 4 by operating the exhaust section 7 so as to discharge gas from the vacuum reaction chamber 4 through the gas discharge ports 42A and 44A. For example, it is advisable to adjust pressure reduction level to about $10^{-3}$ Pa in the vacuum reaction chamber 4 while monitoring the pressure in the vacuum reaction chamber 4 by the pressure gauge 49.

Upon the temperature of the cylindrical base body 1 and the pressure in the vacuum reaction chamber 4 reaching their respective desired levels, then a raw material gas is fed into the vacuum reaction chamber 4 by the raw material gas supply section 6, and also a DC voltage in pulse form is applied between the cylindrical electrode 40 and the support substrate 3. This causes glow discharge to occur between the cylindrical electrode 40 and the cylindrical base body 1 with consequent decomposition of the raw material gas. Components resulting from the raw material gas decomposition are deposited on the surface of the cylindrical base body 1.

Meanwhile, the exhaust section 7 allows the gas pressure in the vacuum reaction chamber 4 to be maintained within a target range. For example, a gas pressure of the vacuum reaction chamber 4 may be set to be not lower than 1 Pa but not higher than 100 Pa.

To feed raw material gases into the vacuum reaction chamber 4, raw material gases stored in the raw material gas tanks 60 to 64 are introduced, through the pipings 60A to 64A, the pipings 65*a* and 65*b*, and the gas introduction ports 45*a* and 45*b*, into the cylindrical electrode 40, with their compositions and flow rates adjusted to the desired levels, by controlling the mass flow controllers 60D to 64D while exercising suitable control over the opening and closing of the valves 60B to 64B and 60C to 64C. While making suitable changes to the composition of the raw material gas, the voltage-resistant layer 11, the charge injection preventive layer 12, the photoconductive layer 13, and the surface protecting layer 14 are laminated one after another in the order named on the surface of the cylindrical base body 1.

The application of a DC voltage in pulse form between the cylindrical electrode 40 and the support substrate 3 is performed by controlling the DC power supply 34 by the control section 35.

In the case where formation of an amorphous silicon (a-Si) is performed while a DC voltage in pulse form is applied so as to impart a negative polarity to the cylindrical base body 1, whereby cations are accelerated and caused to impinge on the cylindrical base body 1, and, sputtering is performed for fine surface asperities by exploiting the impact of cation impingement, there is obtained an amorphous silicon (a-Si) film whose surface has a highly uniform asperity pattern with little growth of appreciable filmy projections. Similar effects can be attained with use of AC voltages adjusted so that each and every voltage has any one of positive and negative polarities, for example.

Moreover, in the case of forming the voltage-resistant layer 11 as an amorphous silicon nitride (a-SiN) deposited film, used as the raw material is a gas mixture of a silicon (Si)-containing gas such as $SiH_4$ (silane gas), a nitrogen (N)-containing gas such as $NH_3$ or $N_2$, and a diluent gas of hydrogen ($H_2$), helium (He), or the like.

In the case of forming the charge injection preventive layer 12 as an amorphous silicon (a-Si) deposited film, used as the raw material gas is a gas mixture of a silicon (Si)-containing gas such as $SiH_4$ (silane gas), a dopant-containing gas such as $B_2H_6$ or $PH_3$, and a diluent gas of hydrogen ($H_2$), helium (He), or the like. As the dopant-containing gas, it is possible to use a raw material gas composed of a boron (B)-containing gas and, on an as needed basis, a nitrogen (N)-containing gas or an oxygen (O)-containing gas, or both of them, or a raw material gas composed of a phosphorus (P)-containing gas and, on an as needed basis, a nitrogen (N)-containing gas or an oxygen (O)-containing gas, or both of them.

In the case of forming the photoconductive layer 13 as an amorphous silicon (a-Si) deposited film, used as the raw material gas is a gas mixture of a silicon (Si)-containing gas such as $SiH_4$ (silane gas) and a diluent gas of hydrogen ($H_2$), helium (He), or the like. In forming the photoconductive layer 13, it is advisable to use hydrogen gas as diluent gas, or to add a halide content to the raw material gas, so that hydrogen (H) or halogen elements (fluorine (F) and chlorine (Cl)) can be contained in the film in an amount of not less than 1% by atom but not more than 40% by atom for dangling-bond termination purposes.

The surface protecting layer 14 is configured to have a multilayer structure consisting of an a-SiC layer and an a-C layer. In this case, used as the raw material gas are a silicon (Si)-containing gas such as $SiH_4$ (silane gas), and a carbon (C)-containing gas such as $C_2H_2$ (acetylene gas) or $CH_4$ (methane gas). A film thickness of the a-C layer constituting the third layer of the surface protecting layer 14 is set to be not less than 0.01 μm but not more than 2 μm, or specifically not less than 0.02 μm but not more than 1 μm, or more specifically not less than 0.03 μm but not more than 0.8 μm, under normal circumstances. Moreover, a film thickness of the surface protecting layer 14 is set to be not less than 0.1 μm but not more than 6 μm, or specifically not less than 0.25 μm but not more than 3 μm, or more specifically not less than 0.4 μm but not more than 2.5 μm, under normal circumstances.

In FIG. 4, there is shown the condition of the part of connection between the cylindrical base bodies 1 (their ends) as observed following the completion of the film-forming process thus far described. In the example shown in FIG. 4, the cylindrical base bodies 1 are directly stacked one on top of another. The electrophotographic photoreceptor 10 as shown in FIG. 1 is obtained by removing the cylindrical base bodies 1 (electrophotographic photoreceptors 10 and 10' which have undergone the film-forming process) from the support substrate 3.

Figure 5:
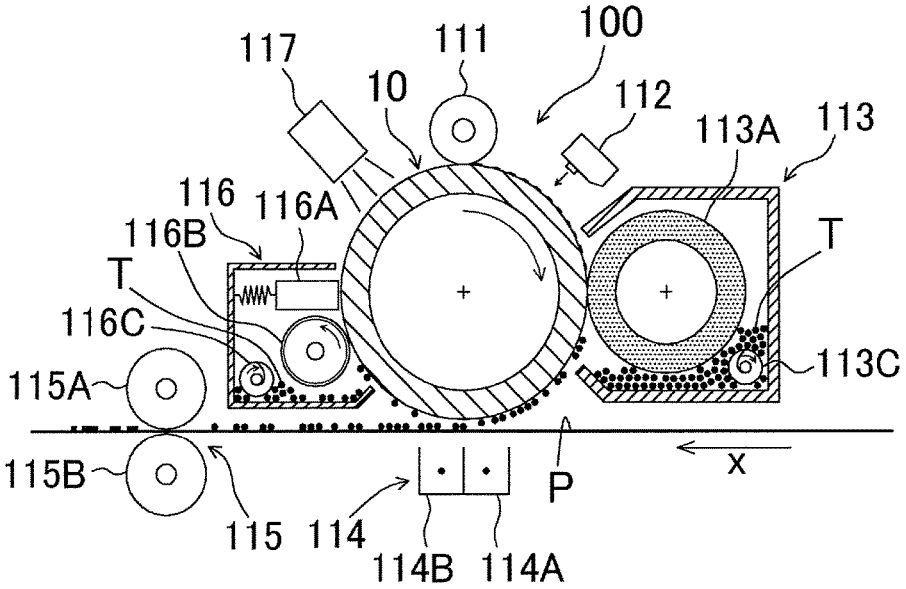
FIG. 5 is a sectional view showing an image forming apparatus in accordance with an embodiment of the invention.

The following describes an image forming apparatus in accordance with an embodiment of the invention with reference to FIG. 5.

The image forming apparatus shown in FIG. 5 employs Carlson process as an image forming method. The image forming apparatus comprises: the electrophotographic photoreceptor 10; a charging device 111; an exposure device 112; a developing device 113 comprising a developing roller 113A and a toner conveyance screw 113C for unused toner agitation; a transfer device 114; a fixing device 115 (115A and 115B); a cleaning device 116 comprising a cleaning roller 116B and a cleaning blade 116A which are in contact with the electrophotographic photoreceptor, and a toner conveyance screw 1160 for residual toner discharge; and a charge-eliminating device 117. The arrow x shown in the drawing indicates the direction of movement of a paper sheet used as a recording medium P.

The charging device (charging roller) 111 serves to charge the surface of the electrophotographic photoreceptor 10 negatively. The charging device 111 adopted in the embodiment is, for example, a contact-type charging device constructed by coating a core bar with a conductive rubber or PVDF (polyvinylidene fluoride).

The exposure device 112 serves to form an electrostatic latent image on the electrophotographic photoreceptor 10. As the exposure device 112, for example, it is possible to use a LED (Light Emitting Diode) head composed of an arrangement of a plurality of LED elements (wavelength: 680 nm).

The developing device 113 serves to form a toner image by developing the electrostatic latent image borne on the electrophotographic photoreceptor 10. The developing device 113 is, as exemplified, provided with a magnetic roller 113A for magnetically retaining a developer (hereinafter referred to as "toner") T.

The toner T constitutes the toner image formed on the surface of the electrophotographic photoreceptor 10, and is frictionally charged in the developing device 113. Examples of the toner T include a two-component developer comprising a magnetic carrier and an insulating toner and a single-component developer comprising a magnetic toner.

The magnetic roller 113A serves to convey the toner T to the surface (development region) of the electrophotographic photoreceptor 10. The magnetic roller 113A conveys the toner T frictionally charged in the developing device 113 in a condition of being regulated to a predetermined length in magnetic brush form. In the range of the development region of the electrophotographic photoreceptor 10, the conveyed toner T adheres to the surface of the electrophotographic photoreceptor 10 under the electrostatic attractive force exerted between the toner and the electrostatic latent image so as to form a toner image (effect visualization of the electrostatic latent image).

Although the developing device 113 is, as exemplified, adapted to a dry development process, a wet development process using a liquid developer may be adopted instead. Moreover, a conveyance screw 113C for agitation of unused toner T (in spiral form) may be disposed inside the developing device 113.

The transfer device 114 serves to transfer the toner image borne on the electrophotographic photoreceptor 10 onto the recording medium P, such as a paper sheet, fed to a transfer region between the electrophotographic photoreceptor 10 and the transfer device 114. The transfer device 114 is, as exemplified, provided with a transfer charger 114A and a separation charger 114B.

As the transfer device 114, it is possible to use a transfer roller which is driven by the rotation of the electrophotographic photoreceptor 10, and is spaced from the electrophotographic photoreceptor 10 through a minute gap (for example, a spacing of less than or equal to 0.5 mm). The transfer roller is configured to apply such a transfer voltage as to attract the toner image borne on the electrophotographic photoreceptor 10 onto the recording medium P by a DC power supply, for example.

The fixing device 115 serves to fix the toner image transferred on the recording medium P on the recording medium P. The fixing device 115 comprises a pair of fixing rollers 115A and 115B. For example, the fixing rollers 115A and 115B are each constructed by applying a surface coating of, for example, tetrafluoroethylene onto a metallic roller.

The cleaning device 116 serves to remove the toner T remaining on the surface of the electrophotographic photoreceptor 10. The cleaning device 116 comprises a cleaning roller 116B and a cleaning blade 116A. The cleaning roller 116B is built as a crowned roller which is thicker at the midportion than at each end. The cleaning roller 116B makes sliding contact with the outer periphery of the electrophotographic photoreceptor 10 so as to form a toner film formed of the residual toner T between the cleaning roller 116B and the electrophotographic photoreceptor 10 for the purpose of cleaning the surface of the electrophotographic photoreceptor 10. The cleaning blade 116A serves to scrape the residual toner off the surface of the electrophotographic photoreceptor 10. For example, the cleaning blade 116A is formed of a rubber material predominantly composed of polyurethane resin.

The charge-eliminating device 117 serves to remove surface charge on the electrophotographic photoreceptor 10. The charge-eliminating device 117 is capable of emitting light of specific wavelength (for example, 630 nm or more). The charge-eliminating device 117 is configured to remove surface charge (residual electrostatic latent image) on the electrophotographic photoreceptor 10 by applying light to the entire axial area of the surface of the electrophotographic photoreceptor 10 by a light source such for example as LED.

The image forming apparatus 100 according to the embodiment can attain the above-described advantageous effects achieved by the electrophotographic photoreceptor 10.

Examples

With various changes made to the shape of the two-step stepped chamfer at each end of the cylindrical base body 1, evaluations were made in respect of the involvement of the shape of the two-step stepped chamfer in trouble such as film separation or dropping-off which occurred at an end of the base body during a film-forming process.

The cylindrical base body 1 was produced from an aluminum alloy-made metal tube (30 mm in outside diameter, 360 mm in length). To begin with, the metal tube was beveled, polished to a mirror-smooth state, and cleaned.

In the beveling process, as a two-step stepped chamfer as shown in FIG. 2, the outer chamfered face 1*b* and the inner chamfered face 1*c* were formed at each end of the cylindrical base body 1 by machining operation using a turning chip. At this time, while making changes to programs stored in a turning machine, there were produced samples of the cylindrical base body 1 which differed from one another in the length L1 (mm) of the outer chamfered face 1*b* of the cylindrical base body 1 in the inclination direction, the length L2 (mm) of the inner chamfered face 1*c* in the inclination direction, the length L3 (mm) of the base body end face 1*d* in the radial direction, the internal angle θ1 (°) defined by the base body outer peripheral face 1*a* and the outer chamfered face 1*b*, and the internal angle θ2 (°) defined by the outer chamfered face 1*b* and the inner chamfered face 1*c*. In this way, there were produced Sample Nos. 1 to 9 in which chamfered faces and end faces of the cylindrical base body 1 were adjusted.

Next, as the process of mirror-finishing the surface of the cylindrical base body 1, the cylindrical base body 1 was held at both ends thereof, and vanishing operation were performed by pressing a diamond tool against the cylindrical base body 1 in a state of rotating rapidly at 1500 to 8000 rpm at the feed rate of 0.08 to 0.5 mm. That is, by pressing the diamond tool which extends deep in the turning direction of work was against the surface of the cylindrical base body 1, a smooth-finished surface (mirror-finished surface) was obtained.

The cylindrical base body 1 thus prepared was conveyed into a clean room, subjected to precision cleaning for the removal of oil content, etc., and then set in the plasma CVD system 20 shown in FIG. 3. Then, the surface layer 2 was formed (constituent layers were stacked) on the surface of each of the cylindrical base bodies 1 (Sample Nos 1 to 9) having their respective end configurations in accordance with the film-forming process as described in the embodiment.

The following describes a specific configuration of each constituent layer.

<Voltage-Resistant Layer>

The voltage-resistant layer 11 was an amorphous silicon nitride (a-SiN) deposited film. A film thickness of the voltage-resistant layer 11 was set to 6 μm.

<Charge Injection Preventive Layer>

The charge injection preventive layer 12 was a layer formed of an amorphous silicon (a-Si)-based material which comprises amorphous silicon (a-Si) with nitrogen (N) and oxygen (O) added, and also contains boron (B) as a dopant. A film thickness of the charge injection preventive layer 12 was set to 4 um.

<Photoconductive Layer>

The photoconductive layer 13 was a layer formed of amorphous silicon (a-Si) having a boron (B) content as a dopant. A film thickness of the photoconductive layer 13 was set to 14 μm.

<Surface Protecting Layer>

The surface protecting layer 14 had a two-layer structure composed of a stack of amorphous silicon carbide (a-SiC) and amorphous carbon (a-C). A thickness of the surface protecting layer 14 was set to 1 μm as the total thickness of the two layers.

Then, on Sample Nos 1 to 9 of the electrophotographic photoreceptor 10 thereby obtained, measurements was made of the dimensions (size) of the end of the cylindrical base body as viewed in lateral section taken along the rotation axis of the cylindrical base body (refer to FIGS. 2A to 2C), and more specifically the length L1 (mm) of the outer chamfered face 1*b*, the length L2 (mm) of the inner chamfered face 1*c*, the length L3 (mm) of the base body end face 1*d*, the internal angle θ1 (°) defined by the base body outer peripheral face 1*a* and the outer chamfered face 1*b*, and the internal angle θ2 (°) defined by the outer chamfered face 1*b* and the inner chamfered face 1*c*.

Moreover, as shown in FIG. 1(*b*), measurements were made of a film thickness D1-D1' (μm) at the boundary between the base body outer peripheral face 1*a* and the outer chamfered face 1*b* (the location corresponding to θ1: θ1 part) in a direction perpendicular to the base body outer peripheral face 1*a*, and a film thickness D2-D2' (μm) at the boundary between the outer chamfered face 1*b* and the inner chamfered face 1*c* (the location corresponding to θ2: θ2 part) in a direction perpendicular to the outer chamfered face 1*b*. The measurements was performed for geometry evaluation by LEXT OLS-4100 3D Measuring Laser Microscope manufactured by Olympus Corporation with use of a 10-power magnifying lens.

A list of the face lengths L1, L2, and L3 (mm) and the internal angles θ1 and θ2 (°) in the obtained different samples is given in Table 1 presented below, and, a list of the film thicknesses D1-D1' and D2-D2' (μm) at the boundary locations in the samples is given in Table 2 which will be presented later.

TABLE 1

| No | Outer chamfered face length L1 (mm) | Inner chamfered face Length L2 (mm) | End face length L3 (mm) | Internal angle θ1 (°) | Internal angle θ2 (°) |
|---|---|---|---|---|---|
| 1 | 0.18 | 0.40 | 0.36 | 135 | 142 |
| 2 | 0.04 | 0.40 | 0.50 | 135 | 142 |
| 3 | 0.15 | 0.40 | 0.39 | 135 | 142 |
| 4 | 0.08 | 0.40 | 0.46 | 135 | 142 |
| 5 | 0.07 | 0.40 | 0.47 | 120 | 157 |
| 6 | 0.40 | 0.18 | 0.42 | 135 | 142 |
| 7 | 0.08 | 0.40 | 0.46 | 140 | 137 |
| 8 | 0.08 | 0.40 | 0.46 | 150 | 127 |
| 9 | 0.08 | 0.40 | 0.44 | 105 | 172 |

in size of 0.04 mm or more and less than 0.06 mm; a group of flaws in size of 0.06 mm or more and less than 0.08 mm; a group of flaws in size of 0.08 mm or more and less than 0.10 mm; and a group of flaws in size of 0.10 mm or more. It is noted that flaws having a size smaller than 0.04 mm will not affect product quality (printed-image quality) unless they are gathered, wherefore the number of such flaws were not counted.

On the basis of the measurement result, the quality of each sample as the electrophotographic photoreceptor product has been determined. More specifically, products that showed substantially no sign of flaws caused by film separation have been rated as being "A"; those that have minute film separation-caused flaws, and yet presented no problem in printed-image quality have been rated as being "B", those that showed signs of film separation, and yet presented no problem in printed-image quality have been rated as being "C", and those that suffered film separation and consequently affected printed-image quality have been rated as "F".

Both the evaluation result and the film-thickness measurement result are given in Table 2.

TABLE 2

| No | Film thickness at outer peripheral face (D1-D1') (μm) | Film thickness at θ2 part (D2-D2') (μm) | Number of flaws (piece) 0.04 mm-0.06 mm | 0.06 mm-0.08 mm | 0.08 mm-0.10 mm | 0.10 mm- | Evaluation |
|---|---|---|---|---|---|---|---|
| 1 | 21.2 | 14.8 | 6 | 4 | 3 | 1 | C |
| 2 | 21.0 | 15.0 | 1 | 0 | 0 | 0 | A |
| 3 | 21.3 | 14.4 | 8 | 2 | 1 | 0 | B |
| 4 | 21.0 | 14.3 | 2 | 1 | 0 | 0 | A |
| 5 | 21.2 | 14.6 | 3 | 0 | 0 | 0 | A |
| 6 | 21.3 | 14.0 | 10 | 6 | 6 | 5 | F |
| 7 | 21.3 | 14.8 | 3 | 2 | 1 | 1 | C |
| 8 | 21.1 | 15.0 | 8 | 3 | 4 | 1 | C |
| 9 | 21.0 | 14.8 | 6 | 2 | 2 | 0 | B |

Then, Sample Nos. 1 to 9 of the electrophotographic photoreceptor 10 were evaluated for the number of flaws (pieces) in the following manner.

The produced samples of the electrophotographic photoreceptor 10 were each incorporated in the modified version of Color Multifunction Printer TASKalfa 3550ci manufactured by KYOCERA Document Solutions Inc. to perform image-printing operation. After determination of the presence of image defects in printed images, the position of a defect in each image was identified, and, a part of the electrophotographic photoreceptor 10 which corresponded to the defective image position was ascertained for the detection of a flaw caused by the separation or dropping-off of the surface layer.

With respect to the detected flaws, the size of each detected flaw was measured by LEXT OLS-4100 3D Measuring Laser Microscope manufactured by Olympus Corporation with use of a 10-power magnifying lens. The size of the flaw was defined as the length of the longest part of the flaw. Moreover, the detected flaws were counted and classified according to size under four groups: a group of flaws Evaluation conclusions have showed that, under the condition where each end of the cylindrical base body 1 which has yet to undergo film formation is configured so that the relationships expressed as: L1<L2; and L2<L3 are employed among the length L3 of the base body end face 1*d*, the length L2 of the inner chamfered face 1*c*, and the length L1 of the outer chamfered face 1*b*, as viewed in lateral section, then the electrophotographic photoreceptor 10 suffers little from trouble such as separation or dropping-off of a film from the end of the cylindrical base body. This makes it possible to reduce the occurrence of image defects ascribable to such a trouble which may be encountered after commercialization. Moreover, even if the trouble such as film separation or dropping-off takes place, the separated or dropped piece is so small that the occurrence of image defects which may be encountered after commercialization can be reduced.

Moreover, when each end of the cylindrical base body 1 which has yet to undergo film formation is configured so that the internal angle θ1 defined by the base body outer peripheral face 1*a* and the outer chamfered face 1*b* is smaller than the internal angle θ2 defined by the outer chamfered face 1*b* and the inner chamfered face 1*c* which is continuous therewith (θ1<θ2), as viewed in lateral section, the electrophotographic photoreceptor 10 suffers less from trouble such as separation or dropping-off of a film from the end of the cylindrical base body. In the case of $\theta 1<\theta 2$, an edge of the $\theta 2$ part becomes gentle, film stress concentration is reduced. This makes it possible to reduce the occurrence of trouble such as film separation or dropping-off more effectively.

As described heretofore, according to the above-described examples, Sample No. 6 has been found to have a plurality of flaws whose maximum size is as large as 0.10 mm or more, and it has been determined to be defective. Although Sample Nos. 1, 7 and 8 have been found to have one flaw whose maximum diameter is as large as 0.10 mm or more, Sample Nos. 2 to 5 and 9 have been found to bear only a few number of minute flaws. That is, samples except for Sample No. 6 have proven themselves as a practically conforming product.

It is needless to say that the invention is not limited to the above-described embodiments, and thus various changes, modifications and improvements are possible without departing from the scope of the invention.

What is claimed is:

1. An electrophotographic photoreceptor, comprising:

a cylindrical base body having an outer peripheral face, an end face, and a chamfered face disposed between the outer peripheral face and the end face; and a surface layer located on the outer peripheral face, the cylindrical base body including an outer chamfered face; and an inner chamfered face lying closer to the end face than the outer chamfered face, a length of the inner chamfered face being larger than a length of the outer chamfered face, as viewed in lateral section taken along a rotation axis of the cylindrical base body.

2. The electrophotographic photoreceptor according to claim 1, wherein a length of the end face in a radial direction thereof is larger than a length of the inner chamfered face, as viewed in lateral section taken along the rotation axis of the cylindrical base body.

3. The electrophotographic photoreceptor according to claim 1, wherein the outer peripheral face and the outer chamfered face are made continuous with each other.

4. The electrophotographic photoreceptor according to claim 1, wherein the outer chamfered face and the inner chamfered face are made continuous with each other.

5. The electrophotographic photoreceptor according to claim 1, wherein the inner chamfered face and the end face are made continuous with each other.

6. The electrophotographic photoreceptor according to claim 1, wherein an internal angle defined by the outer peripheral face and the outer chamfered face is smaller than an internal angle defined by the outer chamfered face and the inner chamfered face, as viewed in lateral section taken along the rotation axis of the cylindrical base body.

7. The electrophotographic photoreceptor according to claim 1, wherein the internal angle defined by the outer peripheral face and the outer chamfered face is more than 90° but not more than 135°, as viewed in lateral section taken along the rotation axis of the cylindrical base body.

8. The electrophotographic photoreceptor according to claim 1, wherein the surface layer lies on the outer chamfered face and the inner chamfered face, and a thickness of a part of the surface layer which lies on the outer chamfered face and the inner chamfered face is smaller than a thickness of a part of the surface layer which lies on the outer peripheral face.

9. The electrophotographic photoreceptor according to claim 1, wherein the surface layer comprises a voltage-resistant layer, a charge injection preventive layer, a photoconductive layer, and a surface protecting layer which are successively arranged in this order in a direction away from the cylindrical base body.

10. The electrophotographic photoreceptor according to claim 1, wherein the surface layer contains amorphous silicon (a-Si).

11. The electrophotographic photoreceptor according to claim 1, wherein the surface layer contains an organic material.

12. An image forming apparatus, comprising:

an electrophotographic photoreceptor according to claim 1.

* * * * *